US012459711B2

(12) United States Patent
Hsieh et al.

(10) Patent No.: US 12,459,711 B2
(45) Date of Patent: Nov. 4, 2025

(54) DRINK CONTAINER AND LID ASSEMBLY THEREOF

(71) Applicant: TIMAS TITAN CO., LTD., Taipei (TW)

(72) Inventors: Han-Chun Hsieh, Taipei (TW); Han-Chieh Hsieh, Taipei (TW)

(73) Assignee: TIMAS TITAN CO., LTD., Taipei (TW)

( * ) Notice: Subject to any disclaimer, the term of this patent is extended or adjusted under 35 U.S.C. 154(b) by 30 days.

(21) Appl. No.: 18/373,368

(22) Filed: Sep. 27, 2023

(65) Prior Publication Data

US 2024/0017892 A1 Jan. 18, 2024

Related U.S. Application Data

(63) Continuation-in-part of application No. 17/577,783, filed on Jan. 18, 2022, now abandoned.

(30) Foreign Application Priority Data

Jun. 8, 2021 (TW) ..... 110206582

(51) Int. Cl.
*B65D 47/08* (2006.01)
*A47G 19/22* (2006.01)
(Continued)

(52) U.S. Cl.
CPC ..... *B65D 47/0876* (2013.01); *A47G 19/2222* (2013.01); *A47G 19/2272* (2013.01);
(Continued)

(58) Field of Classification Search
CPC ..... A47G 19/2205; A47G 19/2222; A47G 19/2266; A47G 19/2272; A47G 21/18; B65D 2543/00092; B65D 2543/00509; B65D 2543/00972; B65D 41/56; B65D 43/0229; B65D 43/164; B65D 47/06;
(Continued)

(56) References Cited

U.S. PATENT DOCUMENTS 5,232,112 A * 8/1993 Howard ..... B65D 25/32 220/768
11,472,611 B1 * 10/2022 Hove ..... B65D 47/14
(Continued)

*Primary Examiner* — James N Smalley
*Assistant Examiner* — Madison L Poos
(74) *Attorney, Agent, or Firm* — Li & Cai Intellectual Property (USA) Office

(57) ABSTRACT

A drink container and a lid assembly thereof are provided. The drink container includes a container body and the lid assembly, the lid assembly includes a first lid and a second lid, the first lid is screwed at an opening end of the container body through screw threads, the first lid has a top portion, and the top portion of the first lid has an opening portion. The second lid is disposed above the first lid, the second lid includes a plunger component, and a bottom portion of the plunger can be engaged with the opening portion and sealed with the opening portion. The plunger component is connected to a connection arm, and one side of the connection arm corresponding to the plunger component is pivotally connected to a pivot portion of the first lid. The plunger component has a second accommodating space configured to accommodate a straw.

18 Claims, 15 Drawing Sheets

(51) Int. Cl.

| | |
|---|---|
| ***B65D 43/02*** | (2006.01) |
| ***B65D 43/16*** | (2006.01) |
| ***B65D 51/18*** | (2006.01) |
| ***B65D 53/02*** | (2006.01) |

(52) U.S. Cl.
CPC ..... *B65D 43/0229* (2013.01); *B65D 43/164* (2013.01); *B65D 51/18* (2013.01); *B65D 53/02* (2013.01); *B65D 2543/00092* (2013.01); *B65D 2543/00509* (2013.01); *B65D 2543/00972* (2013.01)

(58) Field of Classification Search
CPC ..... B65D 47/0857; B65D 47/0876; B65D 5/748; B65D 51/18; B65D 53/02; B65D 85/72
USPC ..... 215/229; 220/241, 242, 252, 254.3, 220/259.1, 707, 212.5, 710.5, 705, 810, 220/836, 345.4
See application file for complete search history.

(56) References Cited

U.S. PATENT DOCUMENTS

| | | | | |
|---|---|---|---|---|
| 2006/0016776 | A1 | 1/2006 | Barre et al. | |
| 2010/0224631 | A1* | 9/2010 | Roth | B65D 45/025 220/288 |
| 2019/0100362 | A1 | 4/2019 | Meyers et al. | |
| 2021/0284427 | A1* | 9/2021 | Rojas | B65D 43/0231 |

* cited by examiner

DRINK CONTAINER AND LID ASSEMBLY THEREOF

CROSS-REFERENCE TO RELATED PATENT APPLICATION

This application is a Continuation-In-Part of the U.S. application Ser. No. 17/577,783, filed on Jan. 18, 2022, and entitled "DRINK CONTAINER AND LID ASSEMBLY THEREOF," now pending. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a drink container and a lid assembly thereof, and more particularly to a drink container and a lid assembly thereof for a user to carry drink or water.

BACKGROUND OF THE DISCLOSURE

With the recent pursuit of environmental protection and attempts at decreasing the use of disposable plastic containers, use of thermos bottles or tumblers for carrying water or beverages has become a trend in the modern society. In addition, in order to reduce the use of the plastic straws, people have turned to using reusable straws made of metal or glass to drink water or beverages.

However, when a conventional thermos bottle is used with a straw, if the straw is too short, the entire straw is prone to sink inside of a container after the straw is inserted into the container. When the straw is required to be used, the straw must be pulled out from an opening of the container with the fingers. Therefore, the use of the straw is inconvenient, and grasping the straw by the fingers can cause the straw to be contaminated.

If a length of the straw is greater than a height of the opening of the container, when the straw is inserted into the container, an upper end of the straw protrudes from a top end of the opening of the container. When the container is closed by a lid thereof, the lid of the container interferes with the upper end of the straw. Accordingly, before the container is closed by the lid, the straw is required to be taken out and stored outside of the container, so that the straw is inconvenient to use therewith, and the straw may be easily contaminated and further affect sanitation.

According to the above, the conventional container is inconvenient to be used with the straw. Therefore, it is important to improve upon the above issues through structural modification.

SUMMARY OF THE DISCLOSURE

In response to the above-referenced technical inadequacies, the present disclosure provides a drink container combination and a lid assembly thereof to improve upon inconveniences involved with a conventional container and straw.

In one aspect, the present disclosure provides a drink container. The drink container includes a container body and a lid assembly. The container body has a first accommodating space therein, and the container body has an opening end at an upper end thereof and an enclosed end at a bottom portion thereof. The lid assembly is movably disposed on the opening end of the container body. The lid assembly includes a first lid and a second lid. The first lid has a top portion. The top portion has an opening portion and a pivot portion, and the opening portion penetrates from a top surface of the top portion to a bottom surface to the top portion. The second lid has a plunger component. A bottom portion of the plunger component is configured to be engaged with the opening portion and sealed with the opening portion. An outer side of the plunger component is connected to a connection arm, and an end of the connection arm corresponding to the plunger component is connected to the pivot portion through a pivot. The second lid is configured to take the pivot as a center to swing back and forth between a closed position and an open position. When the second lid is arranged at the closed position, the bottom portion of the plunger component is engaged with the opening portion, and when the second lid is arranged at the open position, the plunger component is away from the opening portion. The plunger component has a second accommodating space therein facing downwards, and when the second lid is arranged at the closed position, the second accommodating space is arranged above the opening portion, and a gap is between a top wall of the second accommodating space and the top surface of the top portion of the first lid.

In certain embodiments, when the second lid is arranged at the closed position, the gap between the top wall of the second accommodating space of the plunger component and the top surface of the top portion is within a range from 8 mm to 30 mm.

In certain embodiments, a first sealing component is disposed at an engaging position of the first lid and the opening end of the container body, so that the first lid and the opening end of the container body are configured to form a sealed state. The opening portion is a circular opening, the bottom portion of the plunger component is in a cylindrical shape in cooperation with the opening portion, a second sealing component is disposed at an outer side of the bottom portion of the plunger component, and the bottom portion of the plunger component is engaged with the opening portion through the second sealing component, so that the plunger component and the opening portion are configured to form a sealed state.

In certain embodiments, the first lid has a first positioning component near the plunger component, the second lid has a second positioning component at one side of the plunger component facing toward the first positing component, the first positioning component has a first fastening portion, the second positioning component has a second fastening portion corresponding to the first fastening portion, and when the second lid is arranged at the closed position, the first fastening portion is configured to be engaged with the second fastening portion, so that the second lid is positioned at the closed position.

In certain embodiments, an upper end of the plunger component is pivotally connected to a bottom side of the connection arm through a bolt shaft portion, so that the plunger component is rotatably connected to the bottom side of the connection arm. The opening portion has a first screw thread portion at an inner side thereof, a second screw thread portion in cooperation with the first screw thread portion is disposed at a bottom end of the plunger component, and the first screw thread portion and the second screw thread portion are configured to be screwed with each other, so that the plunger component is configured to be fixed at the opening portion.

In certain embodiments, the container body has a concave portion at a bottom portion of the first accommodating space.

In another aspect, the present disclosure provides a lid assembly configured to be disposed at an opening end of a container. The lid assembly includes a first lid and a second lid. The first lid has a top portion. The top portion has an opening portion and a pivot portion, and the opening portion penetrates from a top surface of the top portion to a bottom surface to the top portion. The second lid has a plunger component. A bottom portion of the plunger component is configured to be engaged with the opening portion and sealed with the opening portion. An outer side of the plunger component is connected to a connection arm, and an end of the connection arm corresponding to the plunger component is connected to the pivot portion through a pivot. The second lid is configured to take the pivot as a center to swing back and forth between a closed position and an open position. When the second lid is arranged at the closed position, the bottom portion of the plunger component is engaged with the opening portion, and when the second lid is arranged at the open position, the plunger component is away from the opening portion. The plunger component has a second accommodating space therein facing downwards, and when the second lid is arranged at the closed position, the second accommodating space is arranged above the opening portion, and a gap is between a top wall of the second accommodating space and the top surface of the top portion of the first lid.

In certain embodiments, when the second lid is arranged at the closed position, the gap between the top wall of the second accommodating space of the plunger component and the top surface of the top portion is within a range from 8 mm to 30 mm.

In certain embodiments, the opening portion is a circular opening, the bottom portion of the plunger component is in a cylindrical shape in cooperation with the opening portion, a second sealing component is disposed at an outer side of the bottom portion of the plunger component, and the bottom portion of the plunger component is engaged with the opening portion through the second sealing component, so that the plunger component and the opening portion are configured to form a sealed state. The first lid has a first positioning component near the plunger component, the second lid has a second positioning component at one side of the plunger component facing toward the first positing component, the first positioning component has a first fastening portion, the second positioning component has a second fastening portion corresponding to the first fastening portion, and when the second lid is arranged at the closed position, the first fastening portion is configured to be engaged with the second fastening portion, so that the second lid is positioned at the closed position.

In certain embodiments, an upper end of the plunger component is pivotally connected to a bottom side of the connection arm through a bolt shaft portion, so that the plunger component is rotatably connected to the bottom side of the connection arm. The opening portion has a first screw thread portion at an inner side thereof, a second screw thread portion in cooperation with the first screw thread portion is disposed at a bottom end of the plunger component, and the first screw thread portion and the second screw thread portion are configured to be screwed with each other, so that the plunger component is configured to be fixed at the opening portion.

Therefore, in the drink container and the lid assembly provided by the present disclosure, the drink container can be used together with a straw having a length greater than a height of the drink container. In addition, the second lid can cover the opening portion of the first lid without the need to take out the straw, so that the straw is not required to be separately stored, and a user can immediately suck from the straw after opening the second lid. Accordingly, usage convenience is increased and contamination of the straw can be prevented.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
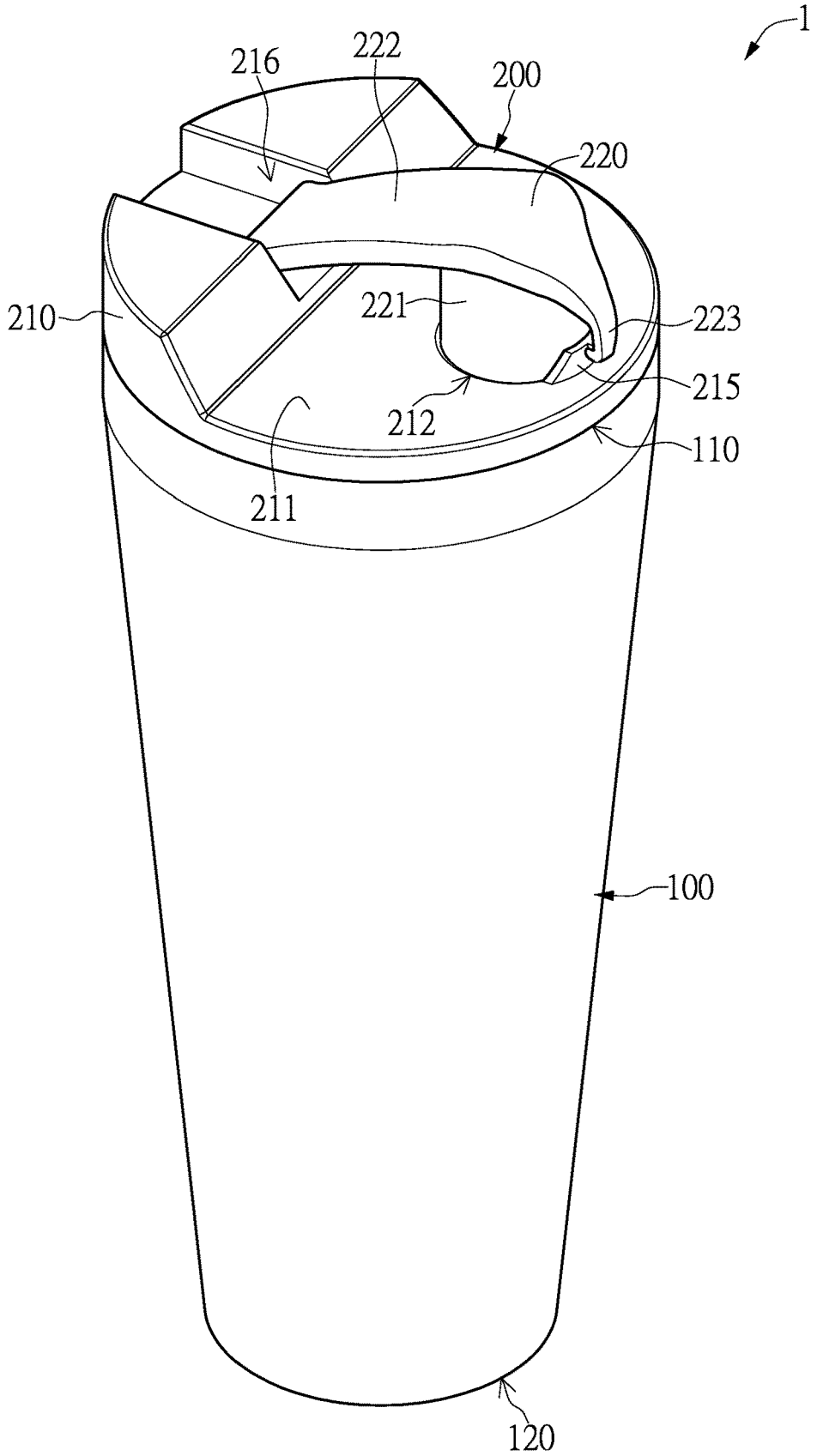
FIG. 1 is a perspective schematic view of a drink container according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 5, a first embodiment of the present disclosure provides a drink container 1, and the drink container 1 includes a container body 100 and a lid assembly 200.

Figure 2:
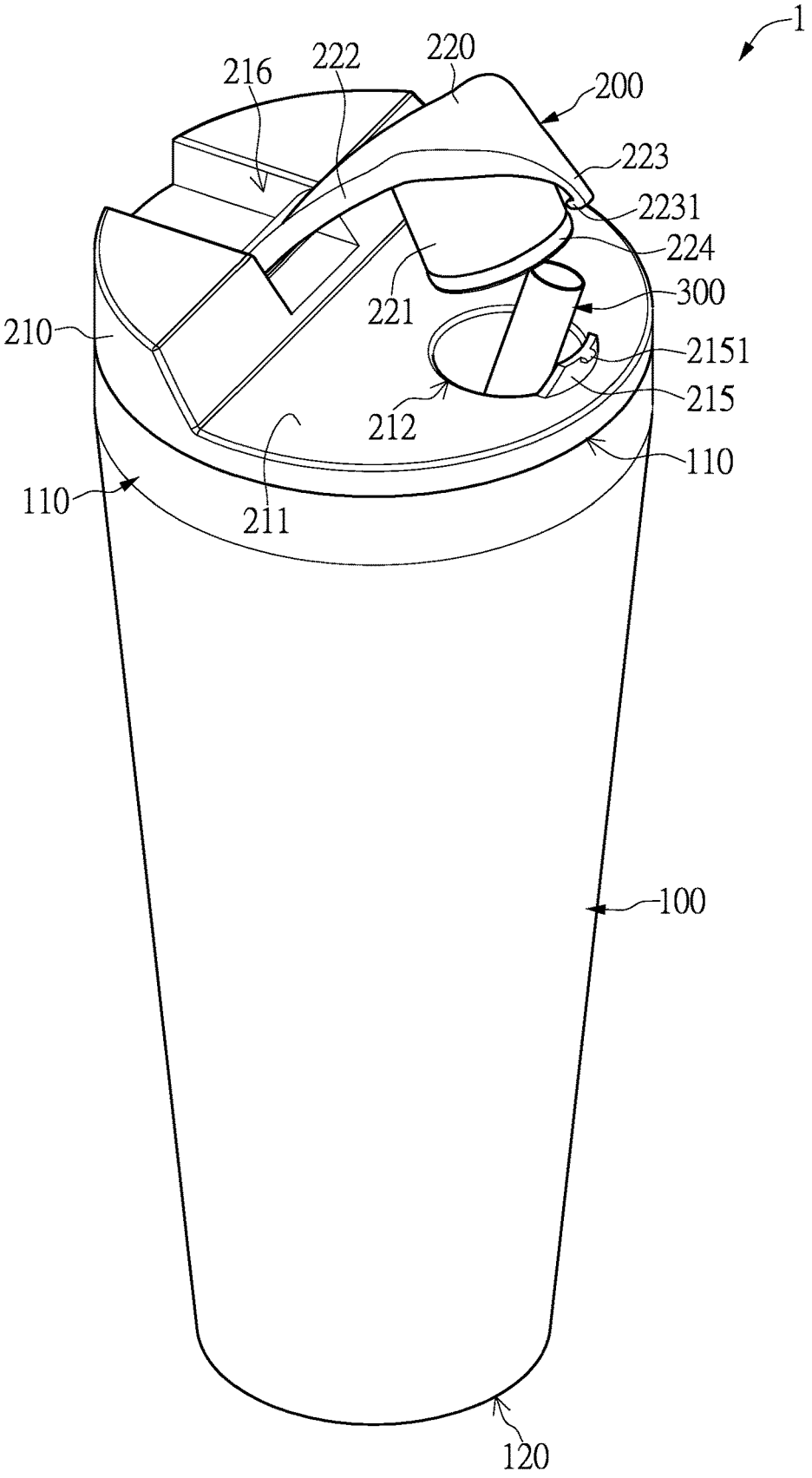
FIG. 2 is a perspective schematic view showing a second lid of the drink container at an open position according to the first embodiment of the present disclosure.
Figure 3:
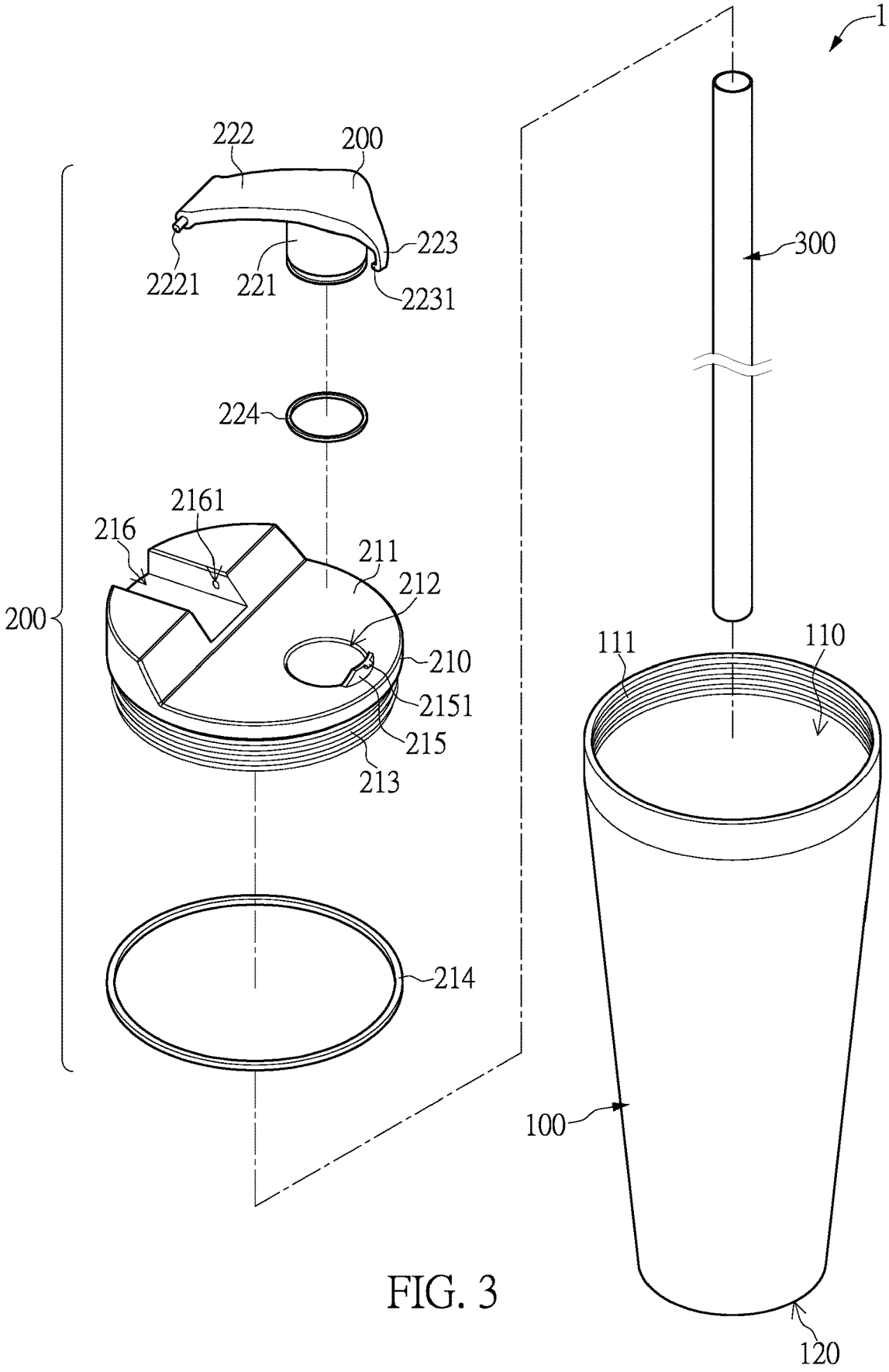
FIG. 3 is an exploded perspective schematic view of the drink container according to the first embodiment of the present disclosure.

As shown in FIG. 1 to FIG. 3, the container body 100 is a cylindrical container that is in a cup shape. In a preferable embodiment, the container body 100 can be a container made of metal, glass, ceramic, or plastic. The container body 100 has a first accommodating space 101 formed therein. The container body 100 has an opening end 110 at an upper end thereof and an enclosed end 120 at a bottom portion thereof. The opening end 110 has an inner screw thread portion 111 on an inner side wall thereof.

Figure 4:
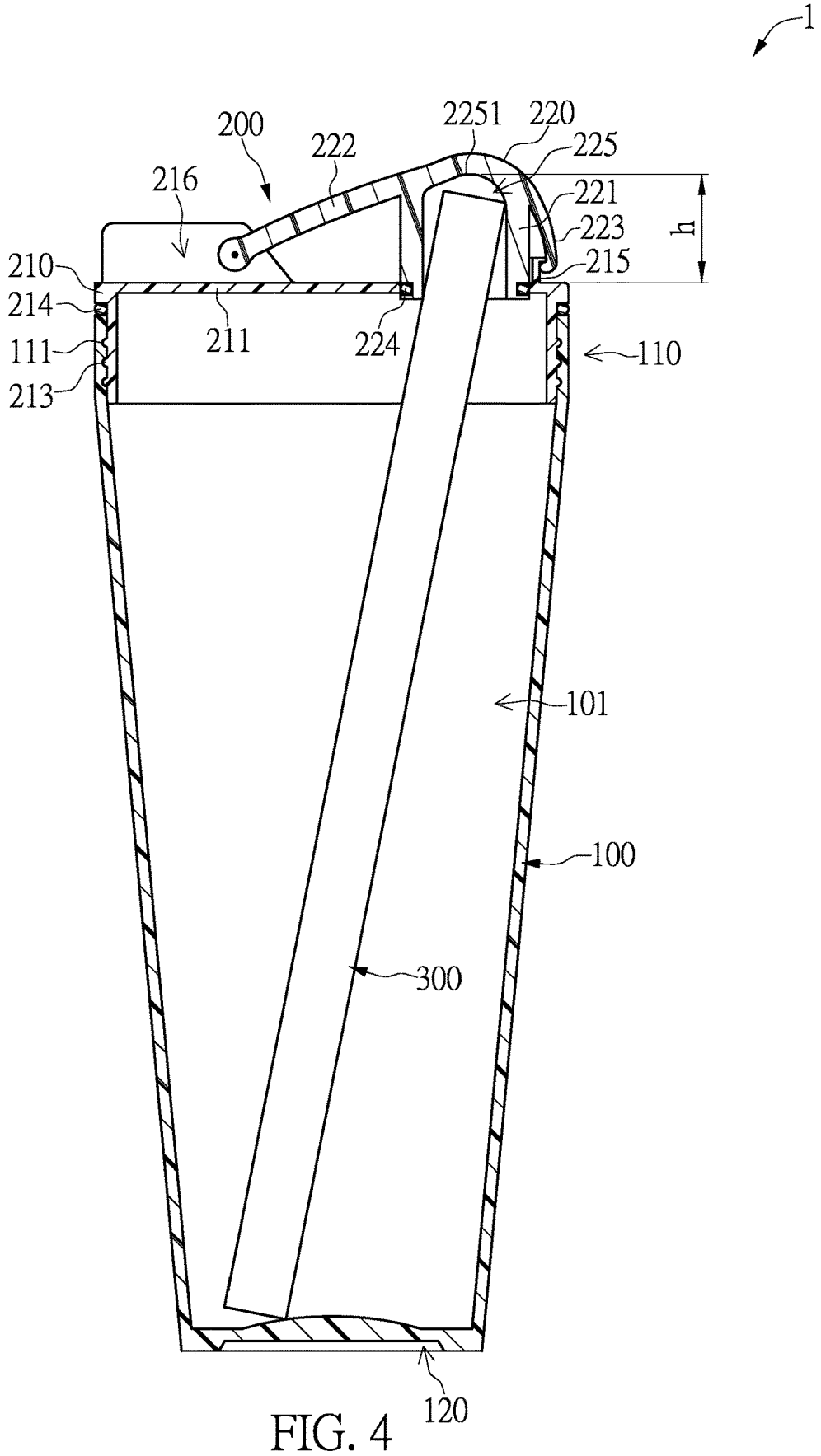
FIG. 4 is an assembled sectional schematic view showing the second lid of the drink container at a closed position according to the first embodiment of the present disclosure.

As shown in FIG. 3 and FIG. 4, the drink container 1 of the present disclosure can allow a straw 300 to be inserted into the first accommodating space 101 of the container body 100, so that a user can suck drink in the drink container 1 through the straw 300.

The lid assembly 200 is movably disposed on the opening end 110 of the container body 100. The lid assembly 200 includes a first lid 210 and a second lid 220. The first lid 210 is substantially in a circular shape. The first lid has a column structure formed at a bottom portion thereof, a diameter of the column structure is slightly less than the opening end 110, the column structure at the bottom portion of the first lid 210 has an outer screw thread portion 213 at an outer side of the column structure, and the outer screw thread portion 213 is in cooperation with the inner screw thread portion 111. The outer screw thread portion 23 can be screwed into the inner screw thread portion 111, so that the first lid 210 can be screwed at the opening portion 110. In addition, a first sealing component 214 of the first lid 210 in an annular shape is disposed at an engaging position of the first lid 210 and the opening end 110, so that the first lid 210 and the opening end 110 can form a sealed state after engaged with each other.

The first lid 210 has a top portion 211 that is in a flat board shape. The top portion 211 has an opening portion 212 at one side thereof, and the opening portion 212 is a circular opening penetrating from a top surface of the top portion 211 to a bottom surface of the top portion 211. More specifically, when the opening portion 212 is opened, the straw 300 can be inserted into the first accommodating space 101 through the opening portion 212, and a length of the straw 300 is greater than a height of the container body 100, so that an upper end of the straw 300 can extend above the opening portion 212, and accordingly, the user can suck the drink in the container body 100 through the straw 300.

The lid assembly 210 has a pivot portion 216 at one side thereof corresponding to the opening portion 212, and the pivot portion 216 is configured to be connected to the second lid 220. In the present embodiment, the pivot portion 216 is a rectangular groove at a protrusion of the top surface of the first lid 210, and the pivot portion 216 has two corresponding pivot holes 2161 at two side walls thereof.

The second lid 220 is movably disposed on the first lid 210. In the present embodiment, the second lid 220 includes a plunger component 221 and a connection arm 222 connected to one side of the plunger component 221. The plunger component 221 is substantially in a cylindrical shape, the plunger component 221 has a column structure at a bottom portion thereof, and the column structure is in cooperation with the opening portion 212. A second sealing component 224 in an annular shape is arranged at an outer side of the bottom portion of the plunger component 221, and when the bottom portion of the plunger component 221 is engaged with the opening portion 212, the bottom portion of the plunger component 221 can be sealed with the opening portion 212 through the second sealing component 224, so that the bottom portion of the plunger component 221 forms a sealed state to prevent fluid from leaking from the opening portion 212.

Figure 5:
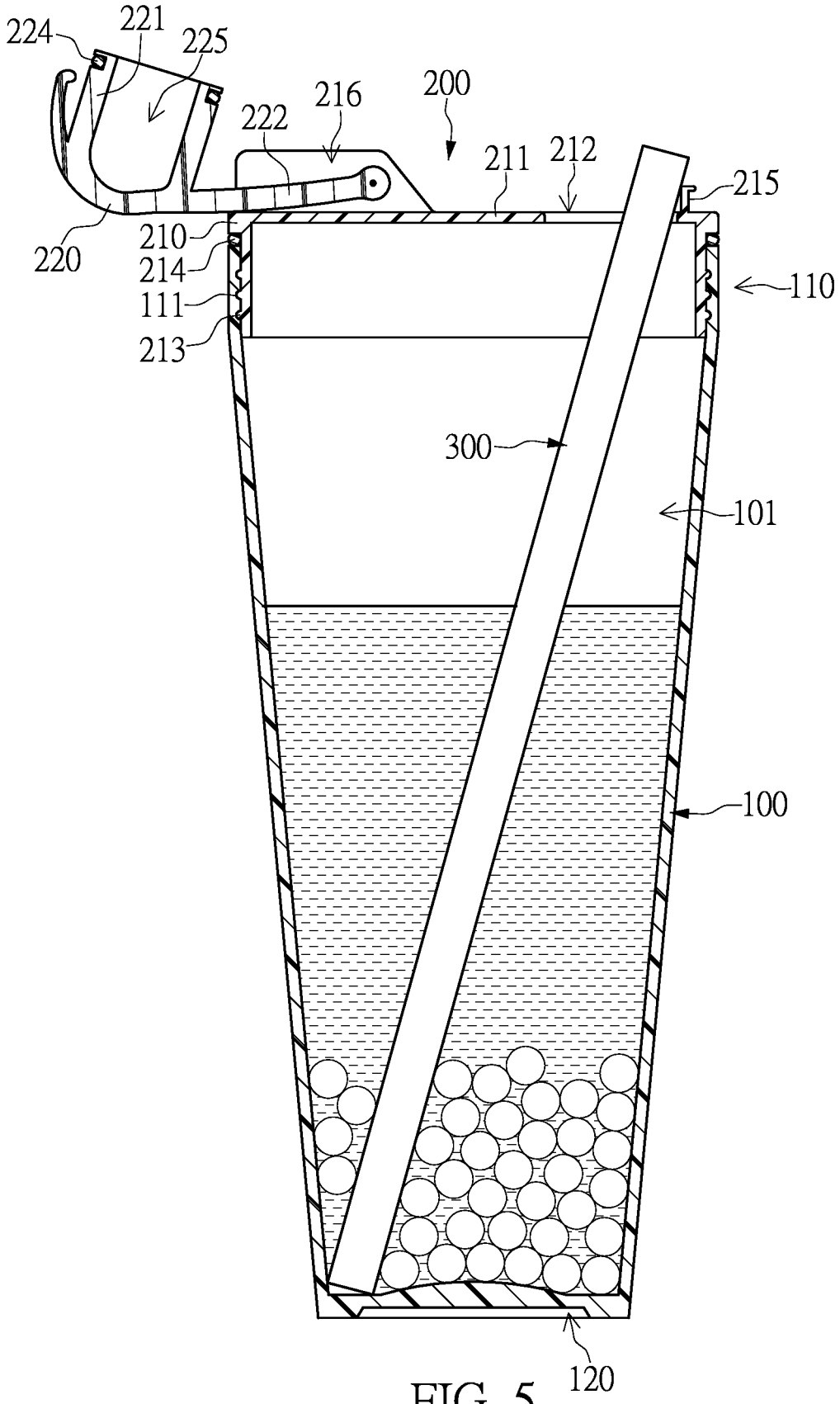
FIG. 5 is an assembled sectional schematic view showing the second lid of the drink container at the open position according to the first embodiment of the present disclosure.

As shown in FIG. 3 to FIG. 5, the connection arm 222 is connected to the one side of the plunger component 221 in a one-piece structure, one end of the connection arm 222 corresponding to the plunger component 221 extends to the pivot portion 216 of the first lid 210 and can be accommodated in the pivot portion 216. The connection arm 222 has two pivots 2221 respectively disposed at two sides of one end of the connection arm 222 corresponding to the plunger component 221, and the two pivots 2221 are configured to be pivotally connected in the two pivot holes 2161 of the pivot portion 216, so that the connection arm 222 is pivotally connected to the pivot portion 216.

Since the connection arm 222 is pivotally connected to the pivot portion 216, the second lid 220 is configured to be pivotally connected to the first lid 210. The second lid 220 is configured to take the pivot 2221 as a center to swing back and forth between a closed position (as shown in FIG. 4) and an open position (as shown in FIG. 5). When the second lid 220 is arranged at the closed position, the bottom portion of the plunger component 221 is engaged with the opening portion 212, and when the second lid 220 is arranged at the open position, the plunger component 221 is away from the opening portion 212.

In the present embodiment, the second lid 220 has a second positioning component 223 at one side thereof facing toward the first positioning component 215, and the second positioning component 223 has a second fastening portion 2231 corresponding to the first fastening portion 2151. As shown in FIG. 1 and FIG. 4, when the second lid 220 is arranged at the closed position, the first fastening portion 2151 is configured to be engaged with the second fastening portion 2231, so that the second lid 220 can be positioned at the closed position, and accordingly, the second lid 220 and the first lid 210 do not separate. More specifically, in the present embodiment, the first fastening component 215 is a protruding sheet formed at one side of the opening portion 212, and the first fastening portion 2151 is a protrusion formed at an outer side surface of the first positioning component 215. The second positioning component 223 is an elastic sheet formed in a one-piece structure at one side of the plunger component 221, and the second fastening portion 2231 is an engaging protrusion arranged at a position of an inner side of the second positioning component 223 corresponding to the first fastening portion 2151.

As shown in FIG. 4 and FIG. 5, the plunger component 221 has a second accommodating space 225 at an inner side thereof, and the second accommodating space 225 faces downwards. When the second lid 220 is arranged at the closed position, an opening of the second opening space 225 is aligned with the opening portion 212, and the second accommodating space 225 is arranged above the opening portion 212 of the first lid 210. As shown in FIG. 4, when the plunger component 221 is engaged with the opening portion 212, a gap h is maintained between a top wall 2251 of the second accommodating space 225 and the top surface of the top portion 211.

As shown in FIG. 4 and FIG. 5, a diameter of the second accommodating space 225 is greater than a diameter of the straw 300, so that an upper end of the straw 300 can be accommodated in the second accommodating space 225 of the second lid 220. Therefore, the drink container 1 of the present disclosure can be in cooperation with the straw 300 having a length greater than a height of the first accommodating space 101 of the container body 100. Moreover, the second lid 220 can cover the opening portion 212 of the first lid 210 and the upper end of the straw 300 without taking out the straw 300, the opening portion 212 of the first lid 210 can be sealed, and the upper end of the straw 300 can be covered at the same time.

In a preferable embodiment, the gap h between the top wall 2251 and the top surface of the top portion 211 is within a range from 8 mm to 30 mm, so that a length of the upper end of the straw 300 extending above the opening portion 212 is long enough for the user to directly bite on the straw 300 to suck the drink, and the user is not required to pull the straw 300 with fingers. The length of the upper end of the straw 300 protruding from the opening portion 212 is less than 30 mm, so that the upper end of the straw 300 does not easily interference with the second lid 220 when the second lid 220 is at the closed position, and a volume of the lid assembly 200 is not too large.

However, the aforementioned description for the drink container 1 and the lid assembly 200 of the first embodiment are merely an example, and are not meant to limit the scope of the present disclosure.

Second Embodiment

Figure 6:
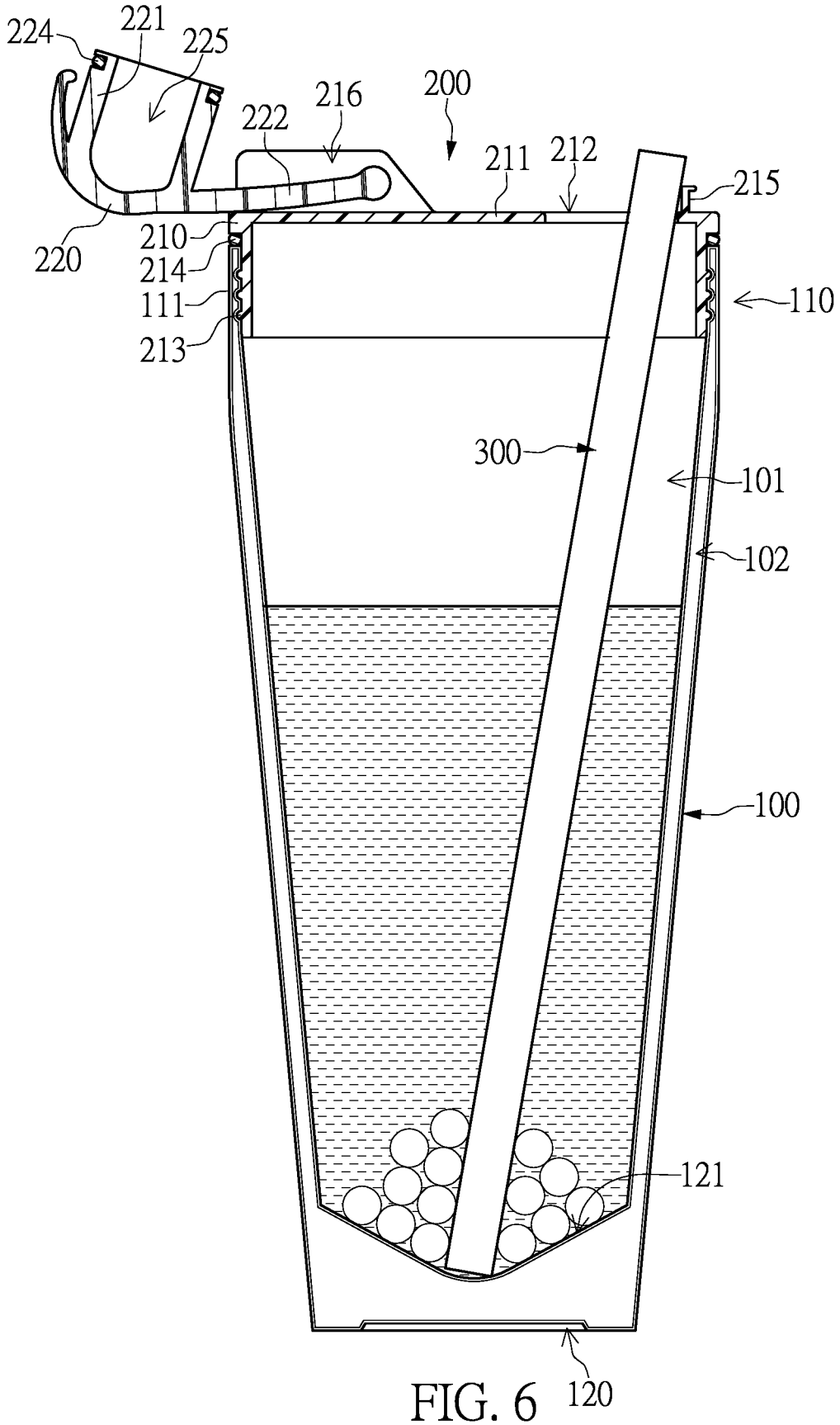
FIG. 6 is an assembled sectional schematic view of the drink container according to a second embodiment of the present disclosure.

Referring to FIG. 6, FIG. 6 shows a second embodiment of the present disclosure. It should be noted that the present embodiment is similar to the above-mentioned first embodiment, the same parts of the first embodiment and the second embodiment will not be reiterated herein.

In the present embodiment, the container body 100 is a vacuum insulating container, the container body 100 has an insulating layer 102 at an inner side thereof, so that the container body 100 can block heat conduction through a vacuum insulating theory to provide a heat preservation effect (i.e., keep something inside of the container body 100 cold or warm).

In addition, in the present embodiment, the container body 100 has a concave portion 121 formed at a bottom portion of the first accommodating space 101, and a bottom-most position of the concave portion 121 is arranged at a center of the bottom portion of the first accommodating space 101. Through the concave portion 121, chewables (e.g., tapioca balls, konjac, or jelly) in the drink can be concentrated and precipitated in the concave portion 121 and can be easily sucked in advantage of the straw 300.

However, the aforementioned description for the drink container 1 of the second embodiment is merely an example, and is not meant to limit the scope of the present disclosure.

Third Embodiment

Figure 7:
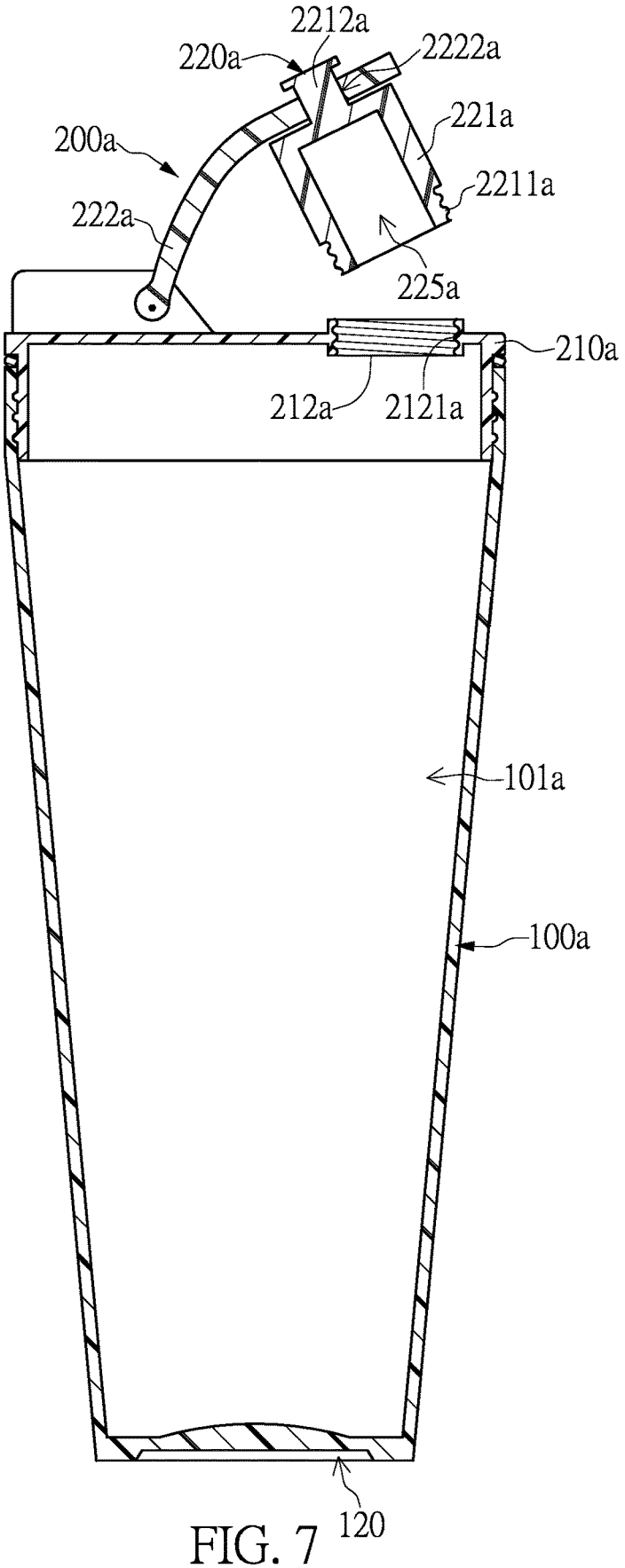
FIG. 7 is an assembled sectional schematic view showing the second lid of the drink container at the closed position according to a third embodiment of the present disclosure.
Figure 8:
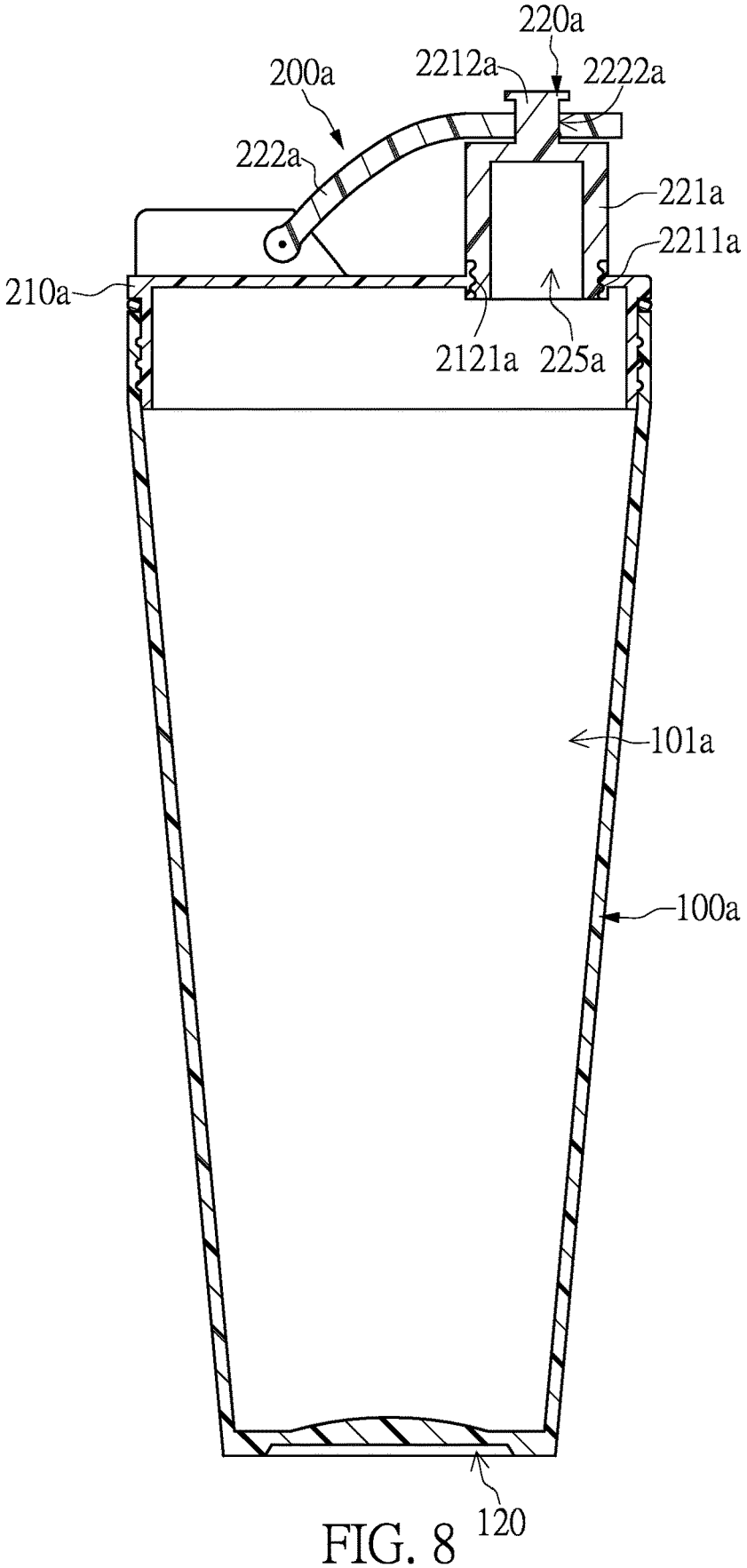
FIG. 8 is an assembled sectional schematic view showing the second lid of the drink container at the open position according to the third embodiment of the present disclosure.
Figure 9:
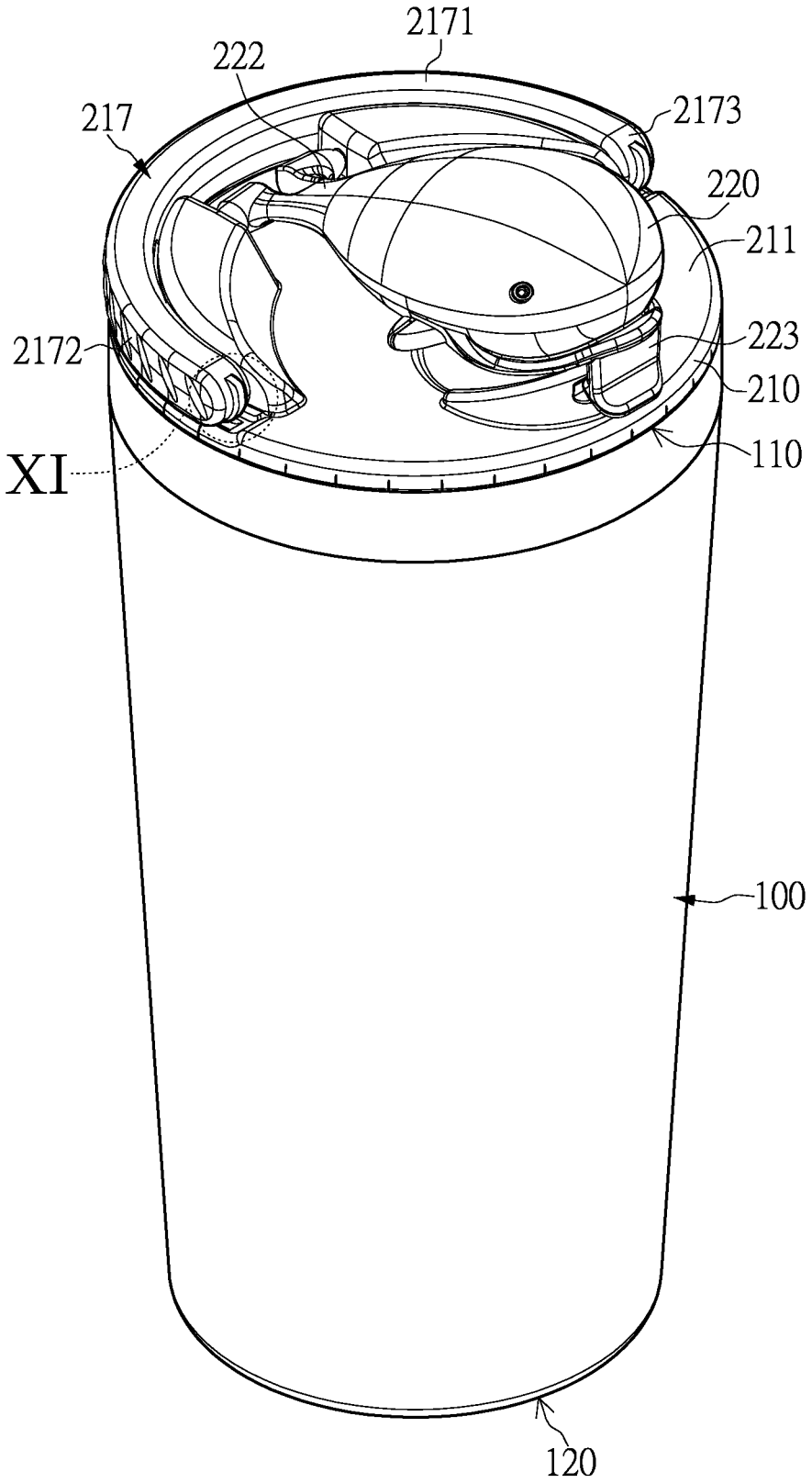
FIG. 9 is a perspective schematic view of the drink container showing a transversal connection portion of a handle is arranged at a placing position according to a fourth embodiment of the present disclosure.
Figure 10:
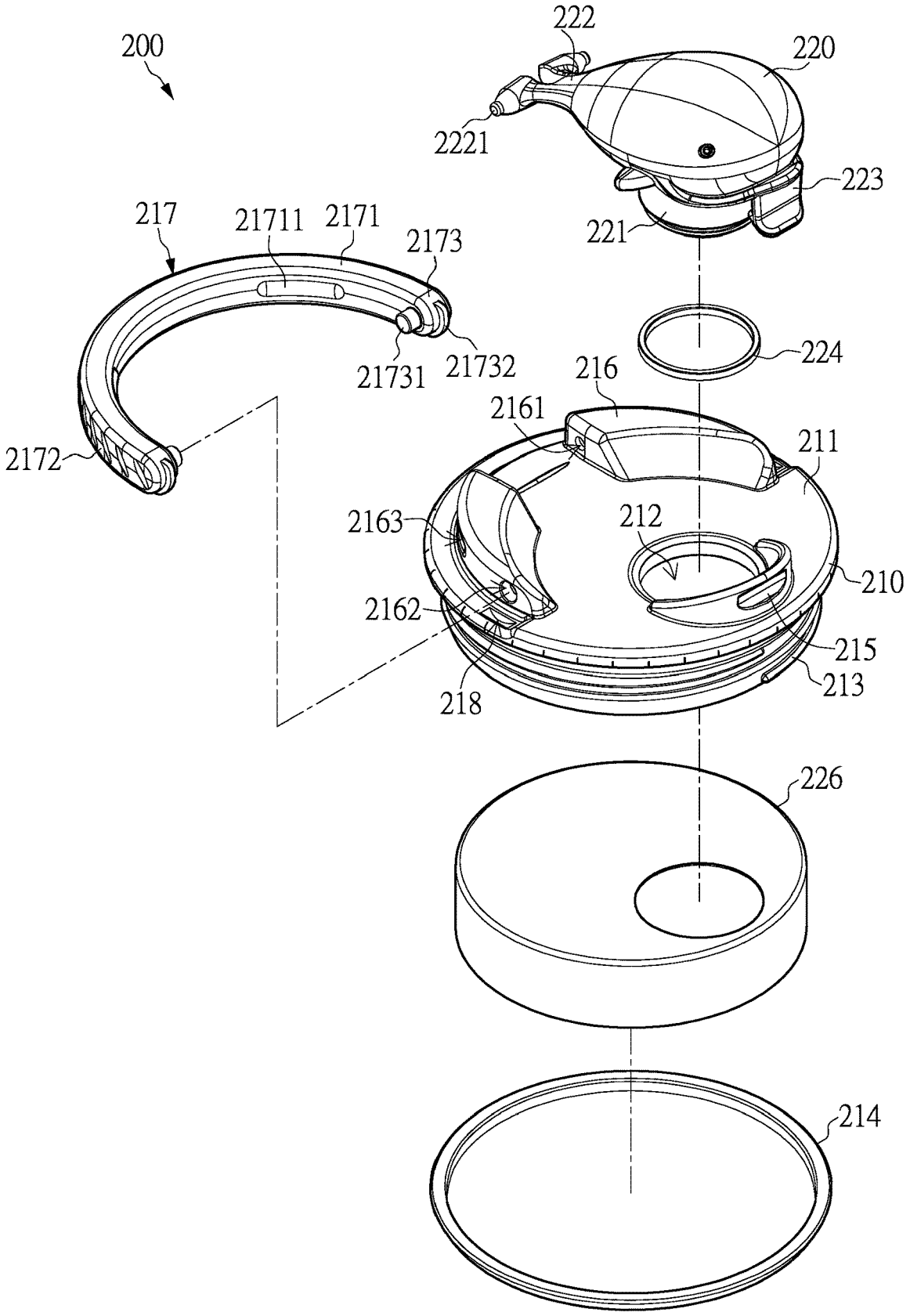
FIG. 10 is a schematic exploded view of the lid assembly of the drink container according to the fourth embodiment of the present disclosure.
Figure 11:
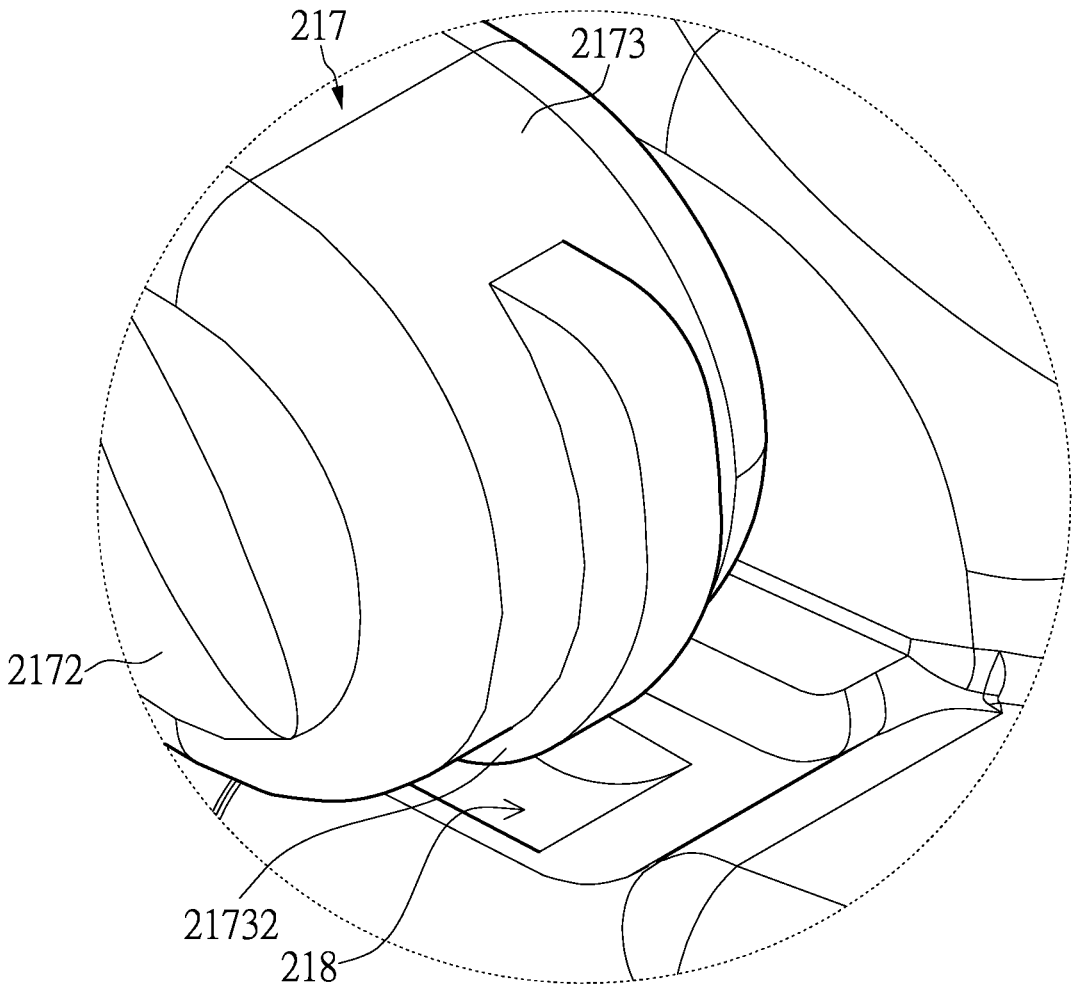
FIG. 11 is a schematic enlarged view of part XI of FIG. 9.
Figure 12:
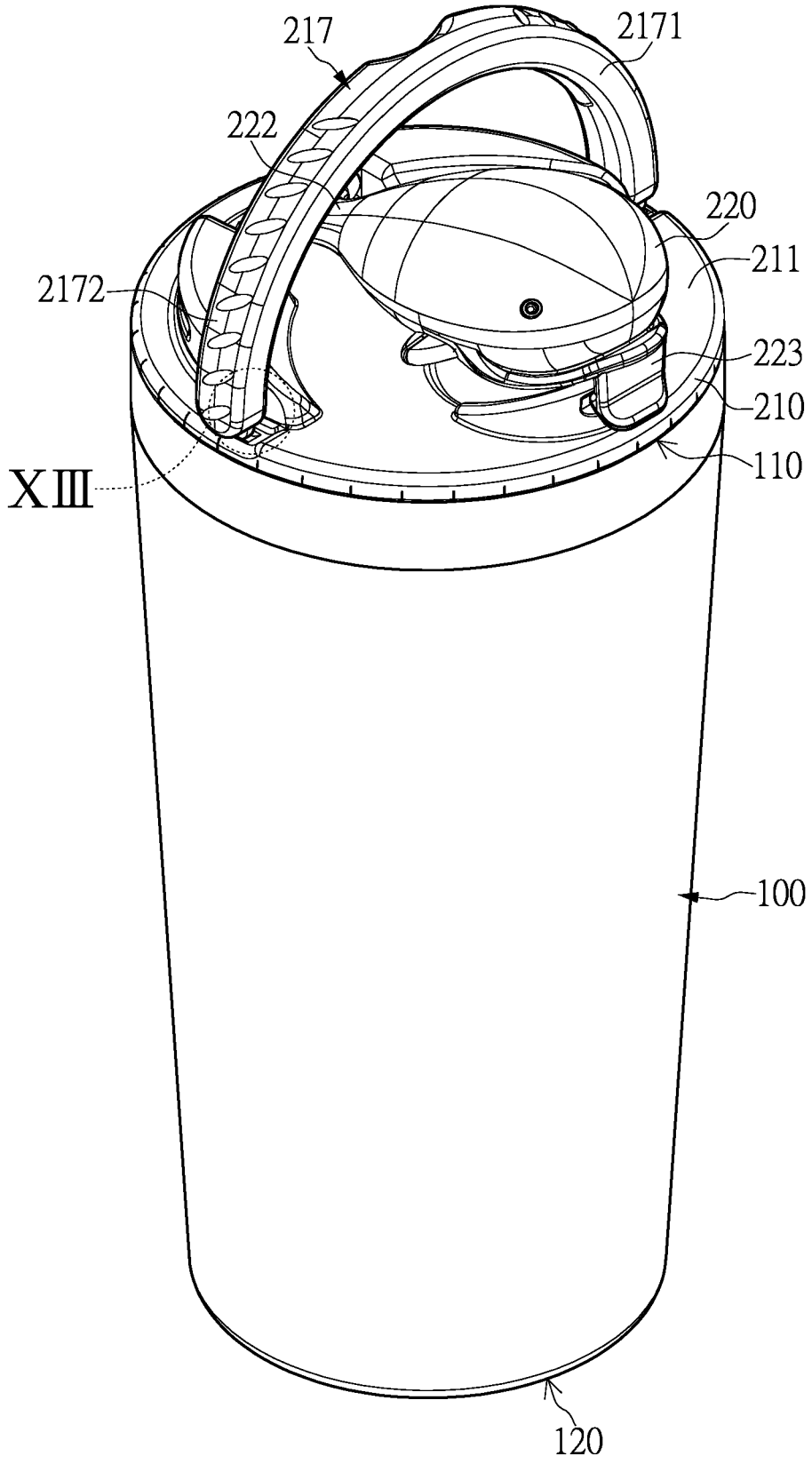
FIG. 12 is a perspective schematic view of the drink container showing the transversal connection portion of the handle is arranged at a pulling position according to the fourth embodiment of the present disclosure.
Figure 13:
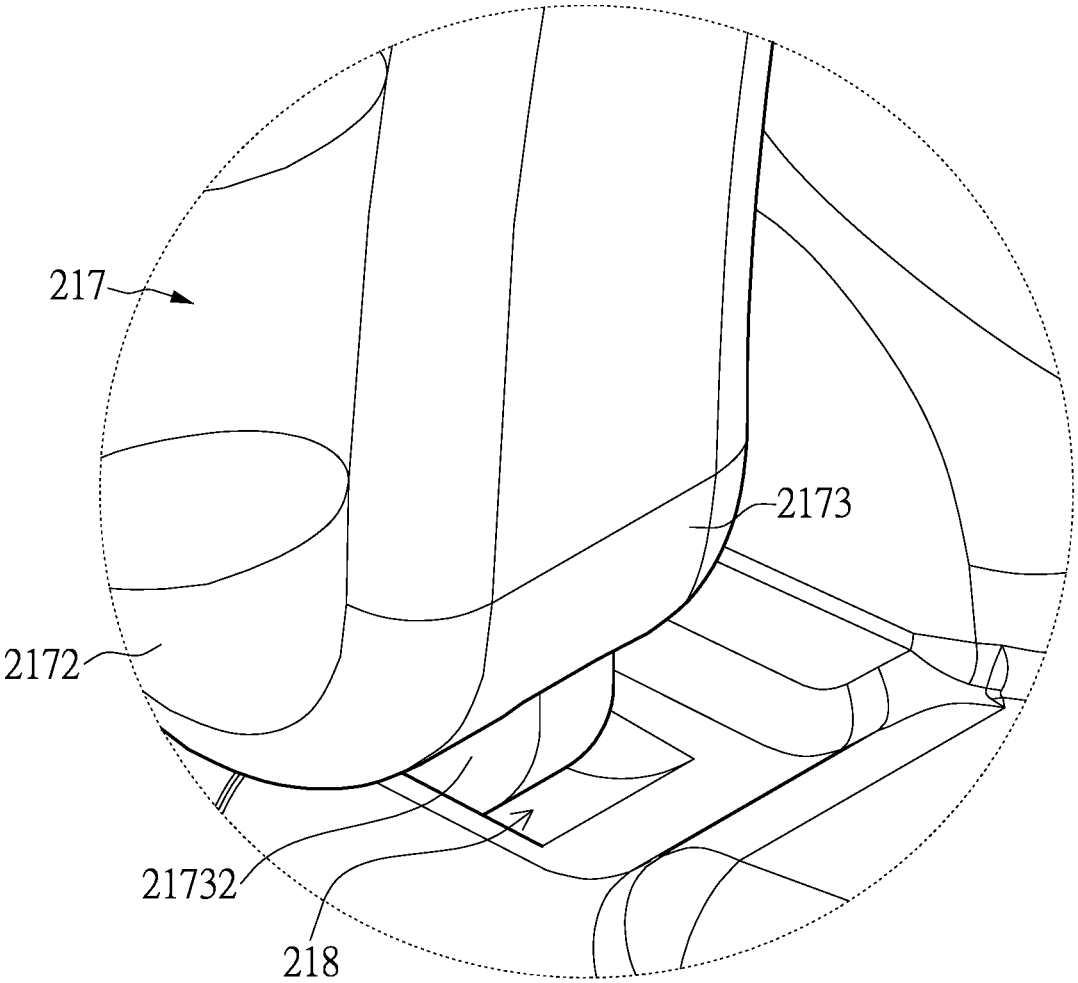
FIG. 13 is a schematic enlarged view of part XIII of FIG. 12.

Referring to FIG. 7 and FIG. 8, FIG. 7 and FIG. 8 show a third embodiment of the present disclosure. It should be noted that the present embodiment is similar to the above-mentioned first embodiment, the same parts of the first embodiment and the third embodiment will not be reiterated herein.

The lid assembly 200*a* of the present embodiment includes a first lid 210*a* and a second lid 220*a*, the first lid 210*a* has an opening portion 212*a*, and the second lid 220*a* is disposed on the first lid 210*a*. The second lid 220*a* includes a plunger component 221*a* and a connection arm 222*a*. In the present embodiment, the plunger component 221*a* has a bolt shaft portion 2212*a* at an upper end thereof, and the connection arm 222*a* has a bolt shaft hole 2222*a* in cooperation with the bolt shaft portion 2212*a*. The plunger component 221*a* can be combined in the bolt shaft hole 2222*a* through the bolt shaft portion 2212*a*, so that the plunger component 221*a* is rotatably and pivotally connected to a bottom side of the connection arm 222*a*. The opening portion 212*a* has a first screw thread portion 2121*a*, and the plunger component 221*a* has a second screw thread portion 2211*a* at a bottom end thereof. The first screw thread portion 2121*a* can be screwed with the second screw thread portion 221*a*, so that the plunger component can be screwed at the opening portion 212*a* to form a sealed state.

However, the aforementioned description for the drink container 1 and the lid assembly 200*a* of the third embodiment are merely an example, and are not meant to limit the scope of the present disclosure.

Fourth Embodiment

Referring to FIG. 9 to FIG. 13, the present embodiment is similar to the above-mentioned first embodiment, the same parts of the first embodiment and the third embodiment will not be reiterated herein.

In the present embodiment, the first lid 210 has a handle 217, two pivot portions 216, and two positioning grooves 218. The two pivot portions 216 have two handle pivot holes 2162, and the two positioning grooves 218 are adjacent to the two handle pivot holes 2162.

The handle 217 has two side portions 2171, a transversal connection portion 2172 arranged between the two side portions 2171 and two end portions 2173 respectively connected to two ends of the two side portions 2171 away from the transversal connection portion 2172. The two end portions 2173 have two handle pivots 21731 configured to be pivotally connected to the two handle pivot holes 2162 and two first ribs 21732 adjacent to the two handle pivots 21731. The handle 217 is configured to rotate relative to the two handle pivots 21731, such that the transversal connection portion 2172 swings between a pulling position and a placing position. When the transversal connection portion 2172 is arranged at the pulling position, the two first ribs 21732 are engaged with the two positioning grooves 218.

When the transversal connection portion 2172 is arranged at the placing position, the two first ribs 21732 are not engaged with the two positioning grooves 218.

The two pivot portions 216 have two positioning recesses 2163, the two side portions 2171 of the handle 217 have two positioning protrusions 21711, and when the transversal connection portion 2172 is arranged at the placing position, the two positioning protrusions 2163 are engaged with the two positioning recesses 2172.

In addition, the lid assembly 200 further includes a metal lining 226 connected to an inner surface of the first lid 210, and accordingly, beverage or water in the drink container 100 is not easily in contact with the first lid 210. Preferably, the metal lining 226 is made of titanium. Since titanium is non-toxic, corrosion-resistant, not easy to stick, and not easy to absorb odors, when the metal lining 226 is in contact with beverage or water in the drink container 100, no chemical material is released into beverage or water. Moreover, the metal lining 226 is not corroded after being in contact with acidic drinks. The metal lining 226 do not absorb odors of the beverage and is not easily adhered with beverage residues.

Fifth Embodiment

Figure 14:
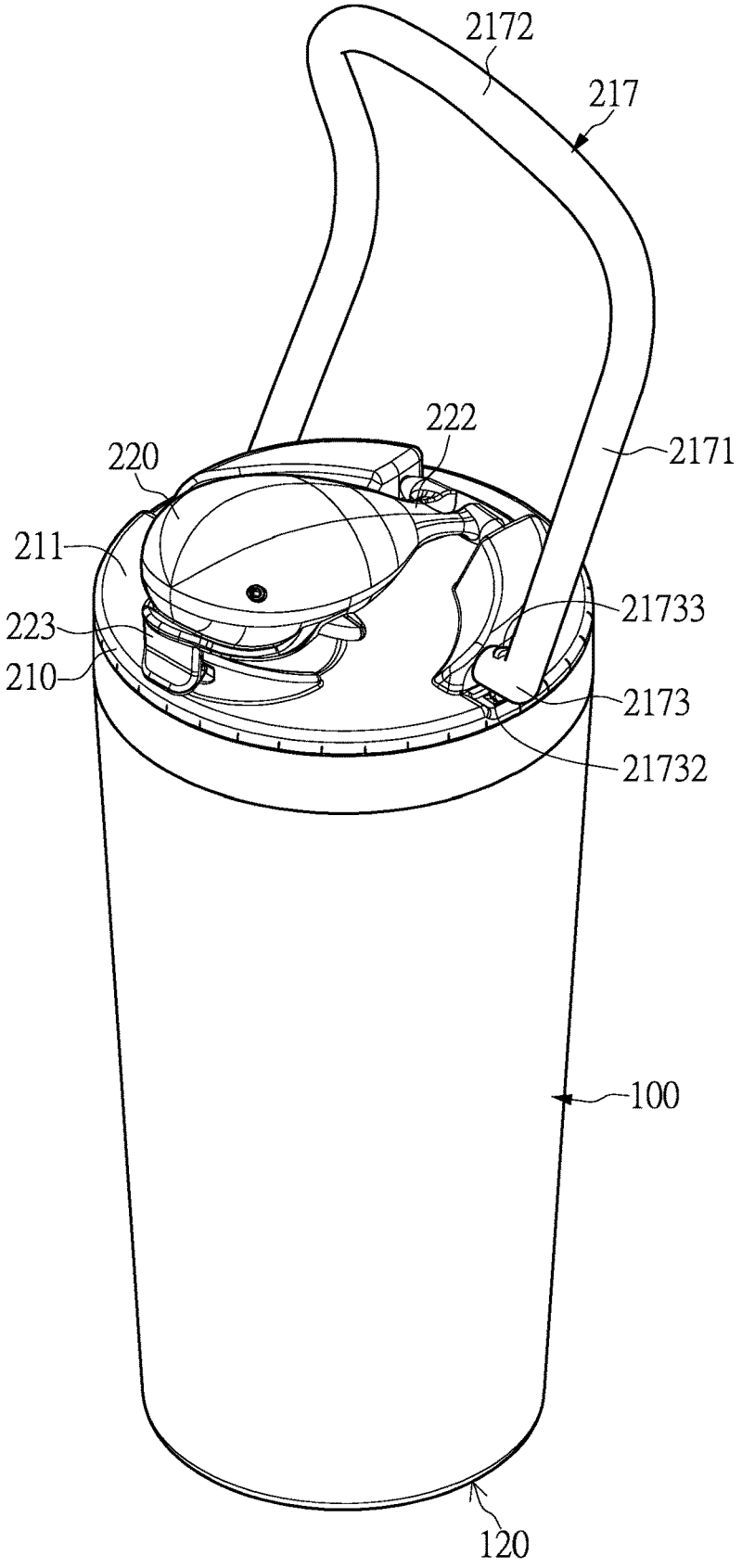
FIG. 14 is a perspective schematic view of the drink container showing the transversal connection portion of the handle is arranged at the pulling position according to a fifth embodiment of the present disclosure.
Figure 15:
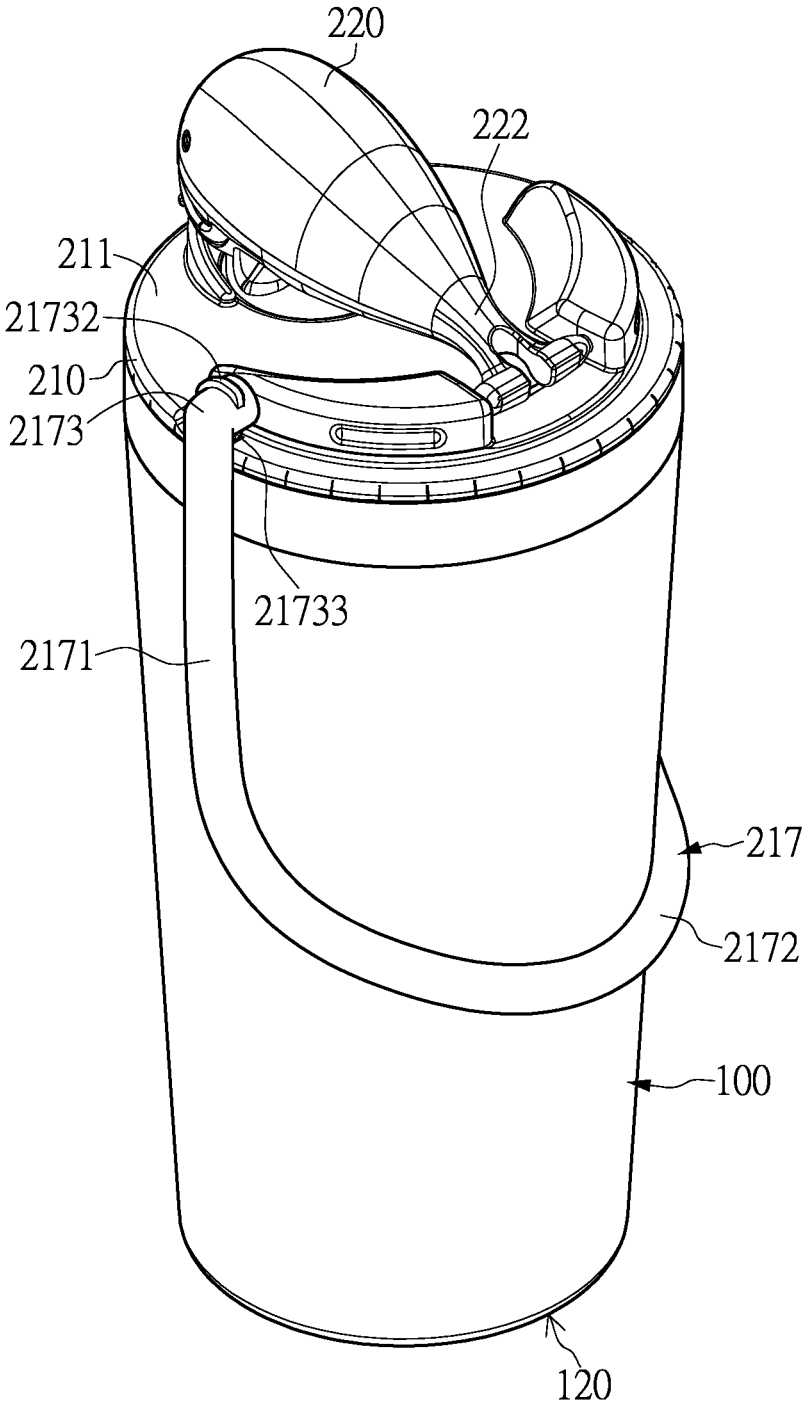
FIG. 15 is a perspective schematic view of the drink container showing the transversal connection portion of the handle is arranged at the placing position according to the fifth embodiment of the present disclosure.

Referring to FIG. 14 and FIG. 15, the present embodiment is similar to the above-mentioned fourth embodiment, the same parts of the fourth embodiment and the fifth embodiment will not be reiterated herein.

In a radial direction, the two end portions 2171 of the handle 217 partially protrude from the first lid 210, and when the transversal connection portion 2172 is arranged at the placing portion, the two side portions 2171 and the transversal connection portion 2172 are connected to an annular side wall of the container body 100.

The two end portions 2171 respectively have two second ribs 21733, and when the transversal connection portion 2172 is arranged at the placing position, the two second ribs 21733 are engaged with the two positioning grooves 218.

Beneficial Effects of the Embodiments

In conclusion, in the drink container and the lid assembly thereof of the present disclosure, since the lid assembly includes the first lid and the second lid, the first lid has the opening portion, the second lid is disposed on the first lid through a pivotal connection, the second lid has the plunger component that is configured to be engaged with the opening portion, and the plunger component has the second accommodating space therein, when the plunger component is engaged at the opening portion, the second space is arranged above the opening portion, and the upper end of the straw protruding from the opening portion can be accommodated in the second accommodating space.

According to the above, the drink container of the present disclosure can be in cooperation with the straw having a length greater than a height of the drink container, and the second lid can cover the opening portion without taking out the straw. Accordingly, the straw is not required to be separately stored, and contamination to the straw can be prevented.

When the user opens the second lid, the upper end of the straw is exposed above the opening portion, and the user can directly suck at the straw with mouth. Accordingly, since the user is not required to pull the straw with fingers, the usage convenience is increased, and the risk of fingers contaminating the straw can be avoided.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A drink container, comprising:

a container body having a first accommodating space therein, wherein the container body has an opening end at an upper end thereof and an enclosed end at a bottom portion thereof; and a lid assembly movably disposed on the opening end of the container body, wherein the lid assembly includes:

a first lid having a top portion and a handle, wherein the top portion has an opening portion, two pivot portions, and two positioning grooves, the two pivot portions have two handle pivot holes, the two positioning grooves are adjacent to the two handle pivot holes, and the opening portion penetrates from a top surface of the top portion to a bottom surface of the top portion, wherein the handle has two side portions, a transversal connection portion arranged between the two side portions, and two end portions respectively connected to two ends of the two side portions away from the transversal connection portion, the two end portions have two handle pivots configured to be pivotally connected to the two handle pivot holes and two first ribs adjacent to the two handle pivots, and the handle is configured to rotate relative to the two handle pivots along a rotation axial, such that the transversal connection portion swings between a pulling position and a placing position, and wherein, the first lid defines a first direction that is along the rotation axial of the two handle pivots, and a second direction that is parallel to a top surface of the top portion and perpendicular to the first direction; the two positioning grooves are recessed downward from the top surface of the top portion and are parallel to the second direction; each of the positioning groove has two side walls arranged at two sides of the positioning groove in the first direction respectively, and when the transversal connection portion is arranged at the pulling position, the two first ribs are engaged with the two positioning grooves, and the two first ribs are arranged between the two side walls of the two positioning grooves in the first direction, so that the two side portions of the handle are not bending outward along the first direction; and a second lid having a plunger component, wherein a bottom portion of the plunger component is configured to be engaged with the opening portion and sealed with the opening portion, wherein an outer side of the plunger component is connected to a connection arm, and an end of the connection arm corresponding to the plunger component is connected to the pivot portion through a pivot, wherein the second lid is configured to take the pivot as a center to swing back and forth between a closed position and an open position, and wherein, when the second lid is arranged at the closed position, the bottom portion of the plunger component is engaged with the opening portion, and when the second lid is arranged at the open position, the plunger component is away from the opening portion, wherein the plunger component has a second accommodating space therein facing downwards, and when the second lid is arranged at the closed position, the second accommodating space is arranged above the opening portion, and a gap is between a top wall of the second accommodating space and the top surface of the top portion of the first lid.

2. The drink container according to claim 1, wherein, when the second lid is arranged at the closed position, the gap between the top wall of the second accommodating space of the plunger component and the top surface of the top portion is within a range from 8 mm to 30 mm.

3. The drink container according to claim 2, wherein a first sealing component is disposed at an engaging position of the first lid and the opening end of the container body, so that the first lid and the opening end of the container body are configured to form a sealed state, and wherein the opening portion is a circular opening, the bottom portion of the plunger component is in a cylindrical shape in cooperation with the opening portion, a second sealing component is disposed at an outer side of the bottom portion of the plunger component, and the bottom portion of the plunger component is engaged with the opening portion through the second sealing component, so that the plunger component and the opening portion are configured to form a sealed state.

4. The drink container according to claim 3, wherein the first lid has a first positioning component near the plunger component, the second lid has a second positioning component at one side of the plunger component facing toward the first positioning component, the first positioning component has a first fastening portion, the second positioning component has a second fastening portion corresponding to the first fastening portion, and when the second lid is arranged at the closed position, the first fastening portion is configured to be engaged with the second fastening portion, so that the second lid is positioned at the closed position.

5. The drink container according to claim 3, wherein an upper end of the plunger component is pivotally connected to a bottom side of the connection arm through a bolt shaft portion, so that the plunger component is rotatably connected to the bottom side of the connection arm, and wherein the opening portion has a first screw thread portion at an inner side thereof, a second screw thread portion in cooperation with the first screw thread portion is disposed at a bottom end of the plunger component, and the first screw thread portion and the second screw thread portion are configured to be screwed with each other, so that the plunger component is configured to be fixed at the opening portion.

6. The drink container according to claim 1, wherein the container body has a concave portion at a bottom portion of the first accommodating space.

7. The drink container according to claim 1, wherein, when the transversal connection portion is arranged at the placing position, the two first ribs are not engaged with the two positioning grooves.

8. The drink container according to claim 1, wherein the two pivot portions have two positioning recesses, the two side portions of the handle have two positioning protrusions, and when the transversal connection portion is arranged at the placing position, the two positioning protrusions are engaged with the two positioning recesses.

9. The drink container according to claim 1, wherein, in a radial direction, the two end portions of the handle partially protrude from the first lid, and when the transversal connection portion is arranged at the placing portion, the two side portions and the transversal connection portion are connected to an annular side wall of the container body.

10. The drink container according to claim 9, wherein the two end portions respectively have two second ribs, and when the transversal connection portion is arranged at the placing position, the two second ribs are engaged with the two positioning grooves.

11. A lid assembly configured to be disposed at an opening end of a container, comprising:

a first lid having a top portion and a handle, wherein the top portion has an opening portion, two pivot portions, and two positioning grooves, the two pivot portions have two handle pivot holes, the two positioning grooves are adjacent to the two handle pivot holes, and the opening portion penetrates from a top surface of the top portion to a bottom surface of the top portion, wherein the handle has two side portions, a transversal connection portion arranged between the two side portions, and two end portions respectively connected to two ends of the two side portions away from the transversal connection portion, the two end portions have two handle pivots configured to be pivotally connected to the two handle pivot holes and two first ribs adjacent to the two handle pivots, and the handle is configured to rotate relative to the two handle pivots along a rotation axial, such that the transversal connection portion swings between a pulling position and a placing position, and wherein, the first lid defines a first direction that is along the rotation axial of the two handle pivots, and a second direction that is parallel to a top surface of the top portion and perpendicular to the first direction; the two positioning grooves are recessed downward from the top surface of the top portion and are parallel to the second direction; each of the positioning groove has two side walls arranged at two sides of the positioning groove in the first direction respectively, and when the transversal connection portion is arranged at the pulling position, the two first ribs are engaged with the two positioning grooves, and the two first ribs are arranged between the two side walls of the two positioning grooves in the first direction, so that the two side portions of the handle are not bending outward along the first direction; and a second lid having a plunger component, wherein a bottom portion of the plunger component is configured to be engaged with the opening portion and sealed with the opening portion, wherein an outer side of the plunger component is connected to a connection arm, and an end of the connection arm corresponding to the plunger component is connected to the pivot portion through a pivot, wherein the second lid is configured to take the pivot as a center to swing back and forth between a closed position and an open position, and wherein, when the second lid is arranged at the closed position, the bottom portion of the plunger component is engaged with the opening portion, and when the second lid is arranged at the open position, the plunger component is away from the opening portion, wherein the plunger component has a second accommodating space therein facing downwards, and when the second lid is arranged at the closed position, the second accommodating space is arranged above the opening portion, and a gap is between a top wall of the second accommodating space and the top surface of the top portion of the first lid.

12. The lid assembly according to claim 11, wherein, when the second lid is arranged at the closed position, the gap between the top wall of the second accommodating space of the plunger component and the top surface of the top portion is within a range from 8 mm to 30 mm.

13. The lid assembly according to claim 12, wherein the opening portion is a circular opening, the bottom portion of the plunger component is in a cylindrical shape in cooperation with the opening portion, a second sealing component is disposed at an outer side of the bottom portion of the plunger component, and the bottom portion of the plunger component is engaged with the opening portion through the second sealing component, so that the plunger component and the opening portion are configured to form a sealed state, and wherein the first lid has a first positioning component near the plunger component, the second lid has a second positioning component at one side of the plunger component facing toward the first positioning component, the first positioning component has a first fastening portion, the second positioning component has a second fastening portion corresponding to the first fastening portion, and when the second lid is arranged at the closed position, the first fastening portion is configured to be engaged with the second fastening portion, so that the second lid is positioned at the closed position.

14. The lid assembly according to claim 13, wherein an upper end of the plunger component is pivotally connected to a bottom side of the connection arm through a bolt shaft portion, so that the plunger component is rotatably connected to the bottom side of the connection arm, and wherein the opening portion has a first screw thread portion at an inner side thereof, a second screw thread portion in cooperation with the first screw thread portion is disposed at a bottom end of the plunger component, and the first screw thread portion and the second screw thread portion are configured to be screwed with each other, so that the plunger component is configured to be fixed at the opening portion.

15. The lid assembly according to claim 11, wherein, when the transversal connection portion is arranged at the placing position, the two first ribs are not engaged with the two positioning grooves.

16. The lid assembly according to claim 11, wherein the two pivot portions have two positioning recesses, the two side portions of the handle have two positioning protrusions, and when the transversal connection portion is arranged at the placing position, the two positioning protrusions are engaged with the two positioning recesses.

17. The lid assembly according to claim 11, wherein, in a radial direction, the two end portions of the handle partially protrude from the first lid, and when the transversal connection portion is arranged at the placing portion, the two side portions and the transversal connection portion are connected to an annular side wall of the container body.

18. The lid assembly according to claim 17, wherein the two end portions respectively have two second ribs, and when the transversal connection portion is arranged at the placing position, the two second ribs are engaged with the two positioning grooves.

* * * * *